US007465056B2

(12) United States Patent
Peng

(10) Patent No.: US 7,465,056 B2
(45) Date of Patent: Dec. 16, 2008

(54) LIGHT EMITTING DIODE LAMP WITH SYNCHRONOUS PINS AND SYNCHRONOUS LIGHT EMITTING DIODE LAMP STRING

(75) Inventor: Jacky Peng, Taipei County (TW)

(73) Assignee: Semisilicon Technology Corp., Taipei County (TW)

( * ) Notice: Subject to any disclaimer, the term of this patent is extended or adjusted under 35 U.S.C. 154(b) by 306 days.

(21) Appl. No.: 11/117,302

(22) Filed: Apr. 29, 2005

(65) Prior Publication Data

US 2006/0133078 A1 Jun. 22, 2006

(30) Foreign Application Priority Data

Dec. 22, 2004 (TW) ..... 93139976 A

(51) Int. Cl.
*F21V 33/00* (2006.01)

(52) U.S. Cl. ..... 362/85; 382/800

(58) Field of Classification Search ..... 362/231, 362/800, 295

See application file for complete search history.

(56) References Cited

U.S. PATENT DOCUMENTS

| | | | | |
|---|---|---|---|---|
| 4,992,704 | A * | 2/1991 | Stinson | 315/312 |
| 6,777,891 | B2 | 8/2004 | Lys et al. | |
| 7,253,566 | B2 | 8/2007 | Lys et al. | |
| 2003/0161154 | A1 * | 8/2003 | Ouyang et al. | 362/295 |

* cited by examiner

*Primary Examiner*—Ali Alavi
(74) *Attorney, Agent, or Firm*—Bacon & Thomas, PLLC

(57) ABSTRACT

The present invention provides a light emitting diode lamp, which includes at least a light emitting diode and a control circuit. The light emitting diode lamp has an anode pin, a cathode pin, and a synchronous pin. The anode pin and the cathode pin receive a DC voltage, and the synchronous pin is connected to the control circuit. Moreover, the present invention provides a synchronous light emitting diode lamp string, which includes a plurality of light emitting diode lamps and at least a power adapter. Each light emitting diode lamp has a synchronous pin, and all synchronous pins are connected together. The control circuit can control the color changing of the light emitting diode based on a reference signal from the synchronous pin.

3 Claims, 12 Drawing Sheets

LIGHT EMITTING DIODE LAMP WITH SYNCHRONOUS PINS AND SYNCHRONOUS LIGHT EMITTING DIODE LAMP STRING

FIELD OF THE INVENTION

The present invention relates to a light emitting device; and more particularly relates to a RGB light emitting diode lamp unit with synchronous signals and a synchronous light emitting diode lamp string.

BACKGROUND OF THE INVENTION

The application of lamp string has been widely used, such as Christmas lamp string, landscape lamp string, and building lamp string, etc. As for the progress of process for the light emitting diode (LED) and lower price thereof, it becomes a new trend to apply LED in the lamp string. But, because LED is basically suitable for DC power and the lamp string is applied in the AC power environment, there have been some products in the market to apply LED in the lamp string. However, how to achieve the synchronous changing will be an obstacle to overcome. The present invention has studied this subject and obtained solid result, so as to submit the patent application.

The current LED lamp string employs the prior art shown in FIG. 1, FIG. 2 and FIG. 3; wherein, each light emitting module represents a set of RGB (three colors) LED lamp unit 2. In the prior art, the technique shown in FIG. 1 is the most undesirable, in which the lamp employed DC parallel type to make all LED lamp units 2 in parallel, so that it has large current consumption, i.e. the power adapter 1 is hard to handle, or with higher cost, or with limited number of LED lamp units 2 in parallel in order to supply large current.

The technique shown in FIG. 2 is better than the technique shown in FIG. 1. Because the LED lamp unit 2 is in serial connection, the current consumption is smaller; and, the power adapter 1 is easily handled and with lower cost. But, this technique still has a defect that the number of LED lamp units 2 to be serially connected are limited, which is determined by the DC voltage supplied by the power adapter 1, i.e. the higher DV voltage, the more LED lamp units 2 to be connected.

The technique shown in FIG. 3 is the best method among the three, which is to replace the power adapter 1 shown in FIG. 1 with each small power adapter 1; wherein, the structure of the small power adapter 1 is simpler, and the lamp units 2 able to be connected have no limits. The only defect is that one LED lamp unit 2 must be associated with one small power adapter 1, so that the product cost is higher.

In the prior art shown in FIG. 1, FIG. 2 and FIG. 3, the conventional LED lamp unit 2 includes a red light emitting diode (R LED), a green light emitting diode (G LED), a blue light emitting diode (B LED) and a control circuit, as shown in FIG. 4. Two pins of the conventional LED lamp unit 2 are connected externally to the positive and negative terminals of the DC power, respectively. The control circuit can be realized as an integrated circuit (IC), which is used to drive the three primary colors RGB LED according to the procedure configured in the original circuit, or to conduct the mixing process of colors. However, the defect for the conventional LED lamp unit 2 is that they should be embedded with independent control ICs, so when applying in the lamp string, the color changing for each LED lamp unit 2 after power on is independently operated without synchronization. If each LED lamp unit 2 can be synchronized, the effect shown by the lamp string must be quite different from the star-studded effect by independent LED lamp units. Thus, how to take care the cost issue but with synchronous effect becomes the research direction in the industry.

SUMMARY OF THE INVENTION

One object of the present invention is to provide a light emitting diode lamp with synchronous signals, and particularly a RGB light emitting diode lamp unit.

Another object of the present invention is to provide a synchronous light emitting diode lamp string, which includes a plurality of light emitting diode lamps, and these light emitting diode lamps are commonly referred to a synchronous signal to change color, wherein the light emitting diodes can be a RGB light emitting diode lamp unit.

The light emitting diode lamp provided by the present invention includes at least a light emitting diode and a control circuit, which is characterized in that, the light emitting diode lamp has an anode pin, a cathode pin and a synchronous pin, and the synchronous pin receives a synchronous signal, and the control circuit can control the lighting of these light emitting diodes based on the synchronous signal.

The RGB light emitting diode lamp unit provided by the present invention includes a red light emitting diode, a green light emitting diode, a blue light emitting diode and a control circuit, which is characterized in that, the RGB light emitting diode lamp unit includes a synchronous pin, in which the synchronous pin receives a synchronous signal, and the control circuit can control the color changing of the red light emitting diode, the green light emitting diode, and the blue light emitting diode based on the synchronous signal.

The synchronous light emitting diode lamp string provided by the present invention includes: a plurality of light emitting diode lamps and a power adapter. The power adapter provides the DC voltage required by these light emitting diode lamps, and these light emitting diode lamps includes at least a light emitting diode and a control circuit for controlling color changing, which is characterized in that, these light emitting diode lamps include an anode pin, a cathode pin and a synchronous pin, and the synchronous pins for each light emitting diode lamp together receive one reference signal, and the control circuit can control the color changing of the light emitting diodes based on the reference signal.

In which, the light emitting diode lamp is a RGB light emitting diode lamp unit. The RGB light emitting diode lamp unit includes a red light emitting diode, a green light emitting diode, a blue light emitting diode and the control circuit. The control circuit can control the color changing of the red light emitting diode, the green light emitting diode and the blue light emitting diode based on the reference signal.

Another synchronous light emitting diode lamp string provided by the present invention includes a plurality of light emitting diode lamps and a plurality of power adapters; wherein, one power adapter provides the DC voltage required by one of the light emitting diode lamp, and the light emitting diode lamp includes at least a light emitting diode and a control circuit for controlling the color changing; which is characterized in that, the light emitting diode lamp unit includes an anode pin, a cathode pin and a synchronous pin. Each power adapter provides a reference signal to the synchronous pin of the light emitting diode lamp, and the control circuit can control the color changing based on the reference signal.

In which, the light emitting diode lamp is a RGB light emitting diode lamp unit. The RGB light emitting diode lamp unit includes a red light emitting diode, a green light emitting diode, a blue light emitting diode and the control circuit. The control circuit can control the color changing of the red light emitting diode, the green light emitting diode and the blue light emitting diode based on the reference signal.

The light emitting diode lamp with synchronous pin and the synchronous light emitting diode lamp string according to the present invention are to make the individual light emitting diode lamp units together referring to one synchronous signal or reference signal to obtain a constant frequency, and further control the color changing or flashing of the light emitting diodes. Also, the lamp string composed of these light emitting diode units can be controlled with color changing or flashing type in a synchronous base to obtain versatile design effects.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE EMBODIMENTS

The present invention has been fully described by referring to the accompanying drawings containing the preferred embodiments according to the present invention. However, before the description, those skilled in the art can modify the invention described in the context and obtain the effect of the present invention. Thus, it should be understood that the description set forth herein is a general disclosure to those skilled in the art, and these contents should not be construed as limitation to the present invention.

Figure 5:
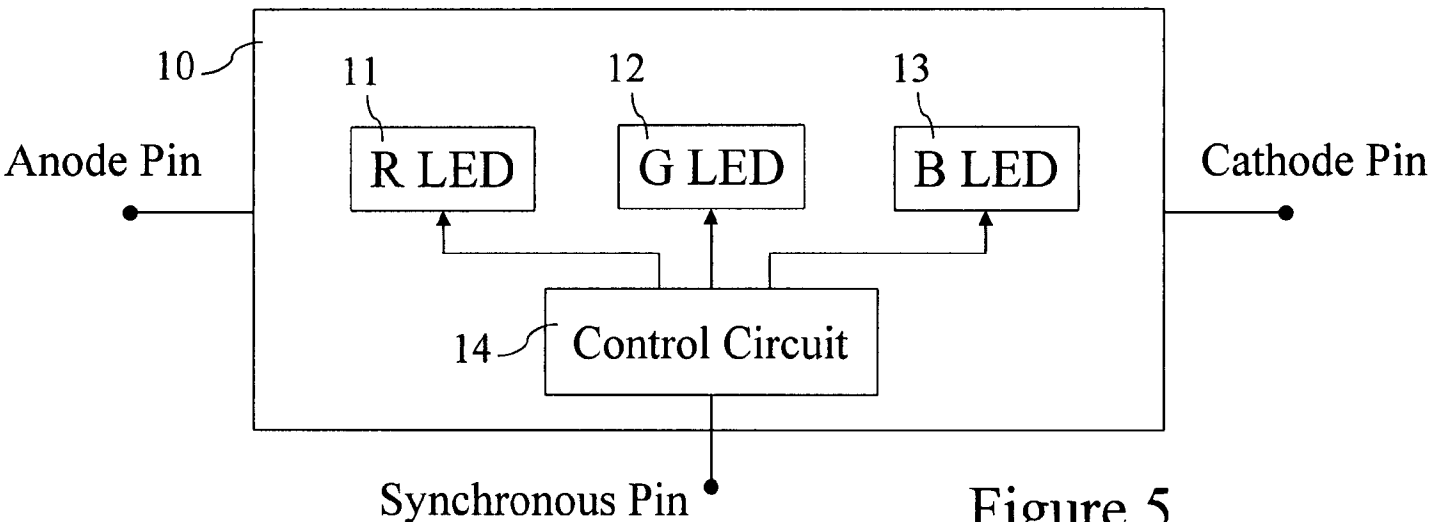
FIG. 5 is a circuit block diagram for the light emitting diode lamp unit according to the present invention.

Referring to FIG. 5, it shows a circuit block diagram for the light emitting diode lamp according to the present invention. The present invention provides a RGB light emitting diode lamp 10, which includes a red light emitting diode (R LED) 11, a green light emitting diode (G LED) 12, a blue light emitting diode (B LED) 13 and a control circuit 14. The control circuit 14 can be realized with an integrated circuit, and the control circuit 14 is configured with a procedure to drive the color changing sequence or flashing type for R LED 11, G LED 12, and B LED 13.

According to a preferred embodiment, the RGB light emitting diode lamp 10 according to the present invention has three pins, which are an anode pin, a cathode pin, and a synchronous pin; wherein, the anode pin and the cathode pin receive a DC voltage, and the DC voltage is the working voltage of the light emitting diode lamp 10, and the synchronous pin is connected to the control circuit 14. According to a different embodiment hereinafter, the control circuit 14 of the RGB light emitting diode lamp unit 10 according to the present invention can output a reference signal (or synchronous signal) with a constant frequency through the synchronous pin, or receive a reference signal (or synchronous signal) through the synchronous pin, and the control circuit can control the color changing of R LED 11, G LED 12, and B LED 13 based on the reference signal (or synchronous signal).

According to the preferred embodiment according to the present invention, the synchronous pin can also be applied in a single-color light emitting diode lamp (not shown). The single-color light emitting diode lamp includes at least a light emitting diode and a control circuit. The light emitting diode is R LED, or G LED, or B LED. The single-color light emitted lamp has three pins, which are an anode pin, a cathode pin and a synchronous pin, wherein the anode pin and the cathode pin receive a DC voltage, and the synchronous pin is connected to the control circuit. Similarly, in different embodiments, the control circuit can output a reference signal (or synchronous signal) with a constant frequency through the synchronous pin, or receive a reference signal (or synchronous signal) through the synchronous pin, and the control circuit can control the color changing of the light emitting diode based on the reference signal (or synchronous signal).

Figure 6:
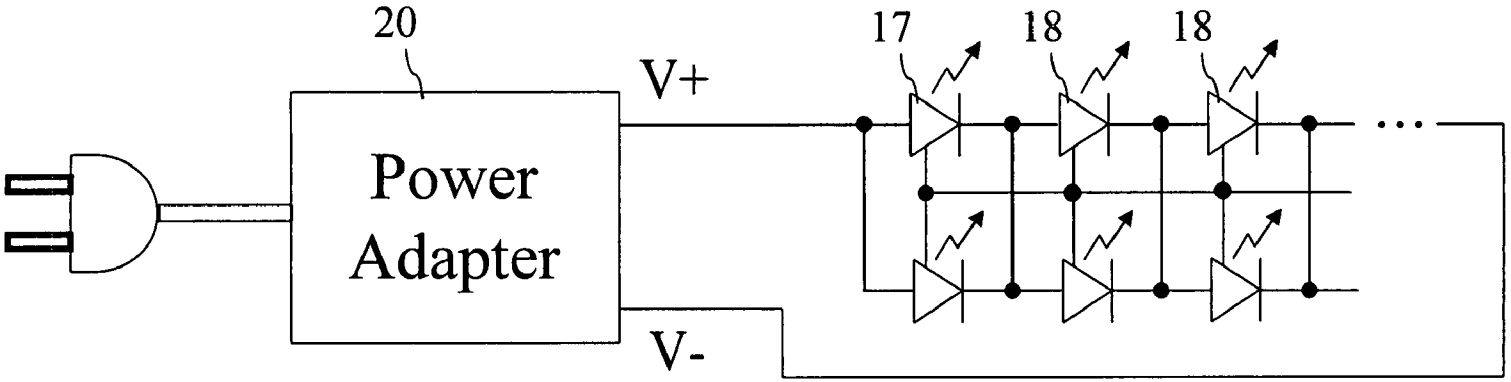
FIG. 6 is a circuit block diagram of the first embodiment for the synchronous light emitting diode lamp string according to the present invention.

Referring to FIG. 6, it shows a circuit block diagram of the first embodiment for the synchronous light emitted lamp string according to the present invention. In the first embodiment according to the present invention, a synchronous light emitting diode lamp string includes a power adapter 20 and a plurality of light emitting diode lamps 10. The power adapter 20 rectifies an AC power to provide a DC power to drive the lamp string composed of the plurality of light emitting diode lamps 10. The light emitting diode lamp 10 may be the RGB light emitting diode lamp as shown in FIG. 5, or the single-color light emitting diode lamp.

In the embodiment shown in FIG. 6, the light emitting diode lamps 10 in parallel are connected in series with each other to form the lamp string, and the synchronous pins of all light emitting diode lamps 10 are connected together. The plurality of light emitting diode lamps 10 include a main light emitting diode lamp 17 and a plurality of sub light emitting diode lamps 18; wherein, the control circuit 14 of the main light emitting diode lamp 17 outputs a reference signal (or synchronous signal) with a constant frequency through the synchronous pin, and other sub light emitting diode lamps 18 receive the reference signal (or synchronous signal) through the synchronous pins, so that all the light emitting diode lamps 10 are synchronously controlled with the color changing or flashing together based on the reference signal (or synchronous signal).

Figure 7:
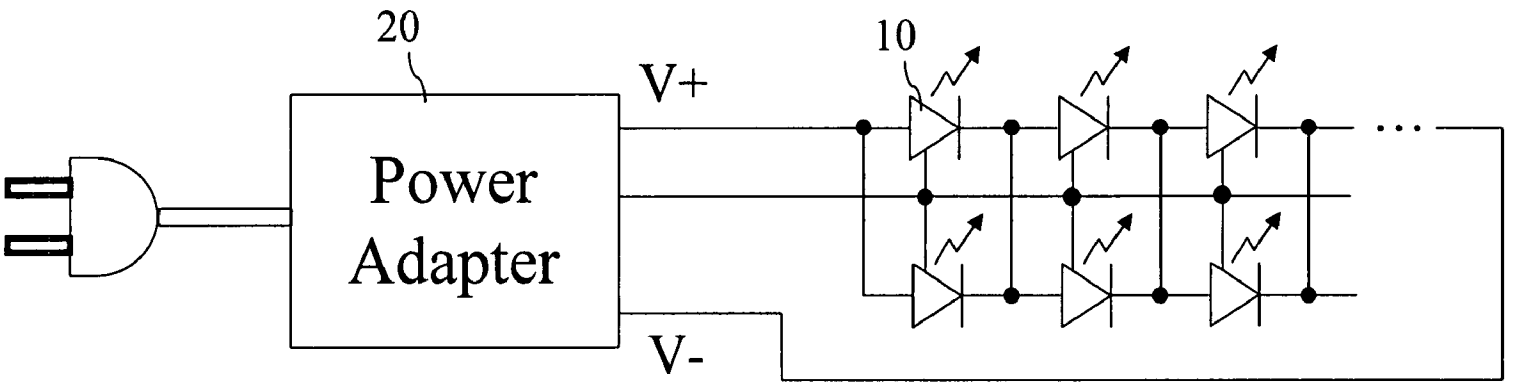
FIG. 7 is another circuit block diagram of the first embodiment for the synchronous light emitting diode lamp string according to the present invention.

Referring to FIG. 7, it shows another circuit block diagram of the first embodiment for the synchronous light emitting diode lamp string according to the present invention. The embodiment shown in FIG. 7 is a modification to the embodiment shown in FIG. 6. In which, the difference is that the light emitting diode lamps 10 composing the lamp string are all the sub light emitting diode lamps 18 in the embodiment shown in FIG. 6, and the synchronous pins of all sub light emitting diode lamps 18 receive the reference signal (or synchronous signal) with a constant frequency outputted from the power adapter 20, so that all sub light emitting diode lamps 18 are controlled synchronously with color changing or flashing together based on the reference signal (or synchronous signal); wherein the frequency of the reference signal (or synchronous signal) is generated by the frequency of the AC power inputted from the power adapter 20.

Figure 8:
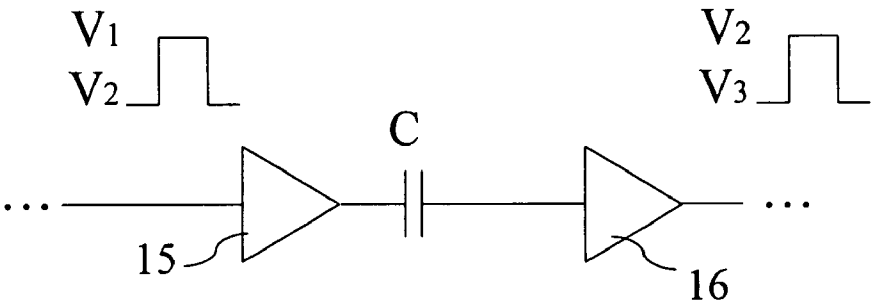
FIG. 8 is a driving circuit diagram of the synchronous ping in each light emitting diode lamp unit of the synchronous light emitting diode lamp string according to the present invention.

In the embodiments shown in FIG. 6 and FIG. 7, the structure composing the lamp string is in serial connection; in other words, the cathode pin of the previous level of RGB light emitting diode lamp unit (or single-color light emitting diode lamp) is connected to the anode pin of the next level of RGB light emitting diode lamp unit (or single-color light emitting diode lamp), so the potentials for each level of the light emitting diode lamps are not equal. At this time, the reference signal (or synchronous signal) with a constant frequency is transmitted to the synchronous pin of the next level of light emitting diode lamps, and the control circuit cannot recognize. Thus, the design for the synchronous pins between the previous and next levels is especially designed with a circuit for signal recognition, as shown in FIG. 8. The output buffer 15 and the input buffer 16 between the synchronous pins of the previous and next levels are connected through a capacitor C. Thus, the synchronous pins for each level of the light emitting diode lamps all can obtain the reference signal (or synchronous signal) from the same frequency source to achieve the synchronized operation for the lamp string.

Figure 1:
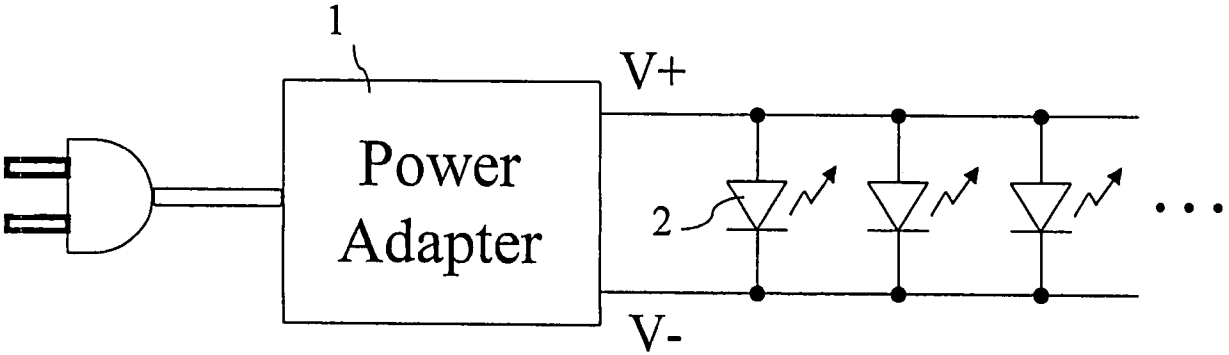
Figure 1 PRIOR ART
FIG. 1 is a circuit block diagram for the first type of LED lamp string in the prior art.
Figure 2:
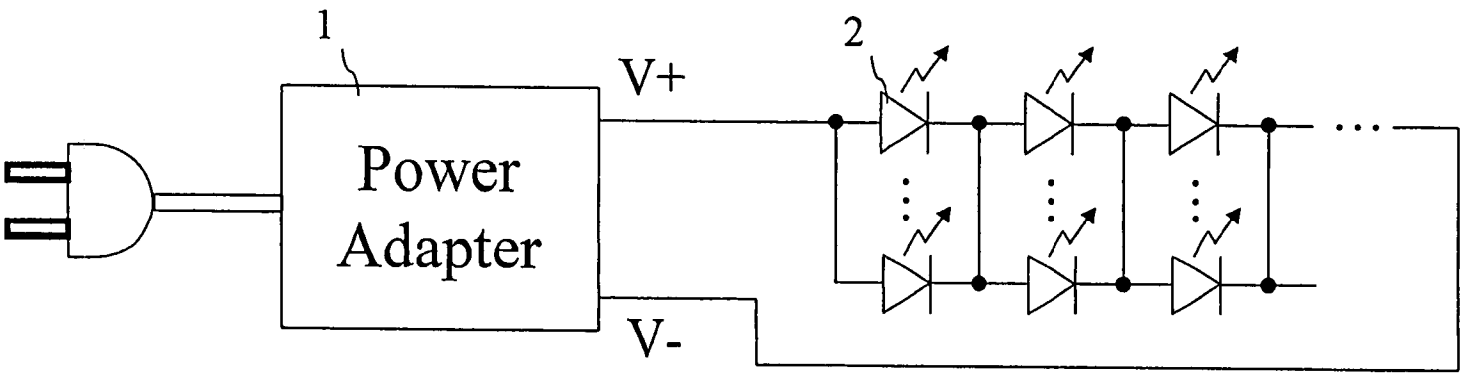
Figure 2 PRIOR ART
FIG. 2 is a circuit block diagram for the second type of LED lamp string in the prior art.
Figure 3:
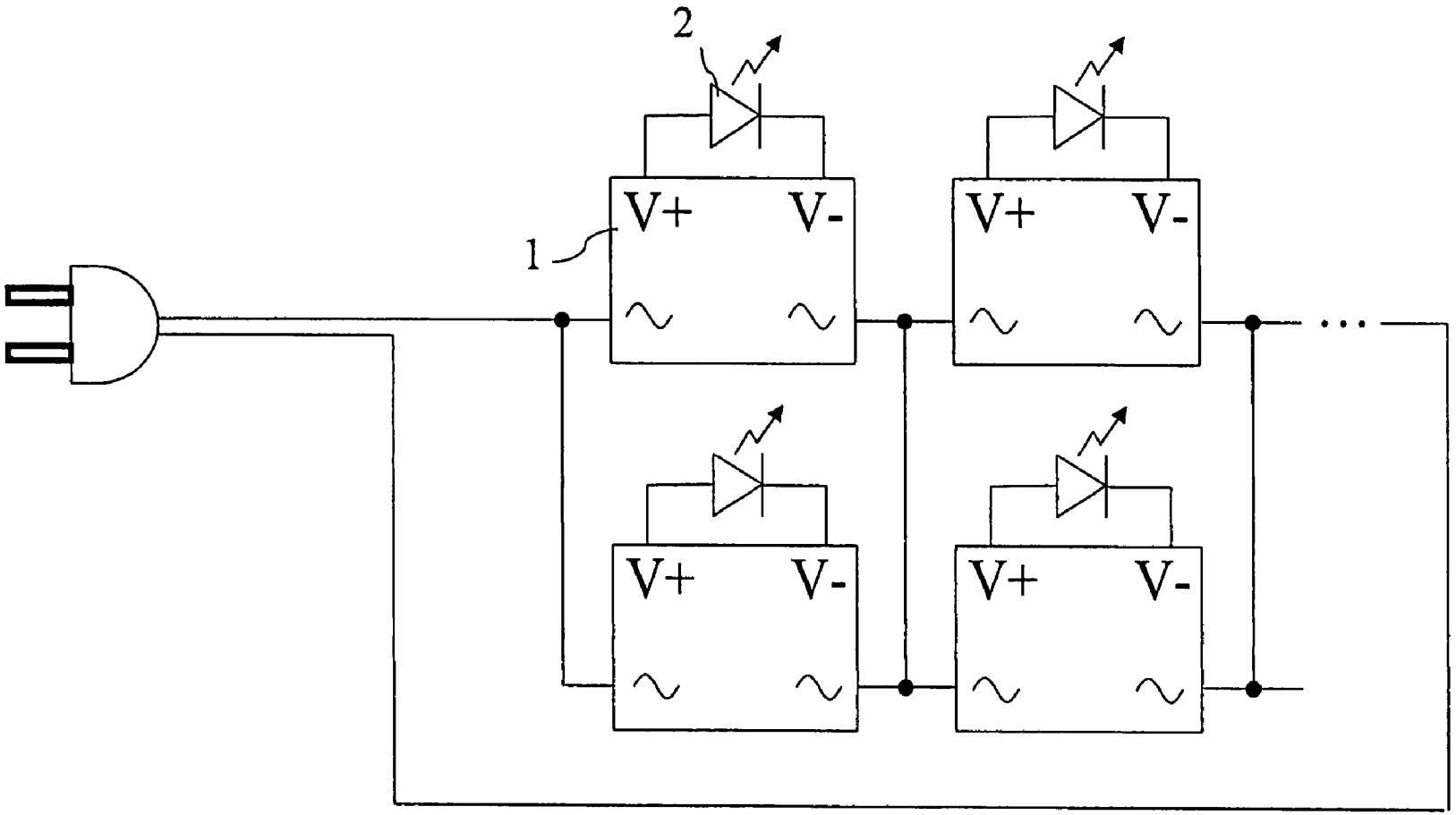
Figure 3 PRIOR ART
FIG. 3 is a circuit block diagram for the third type of LED lamp string in the prior art.
Figure 4:
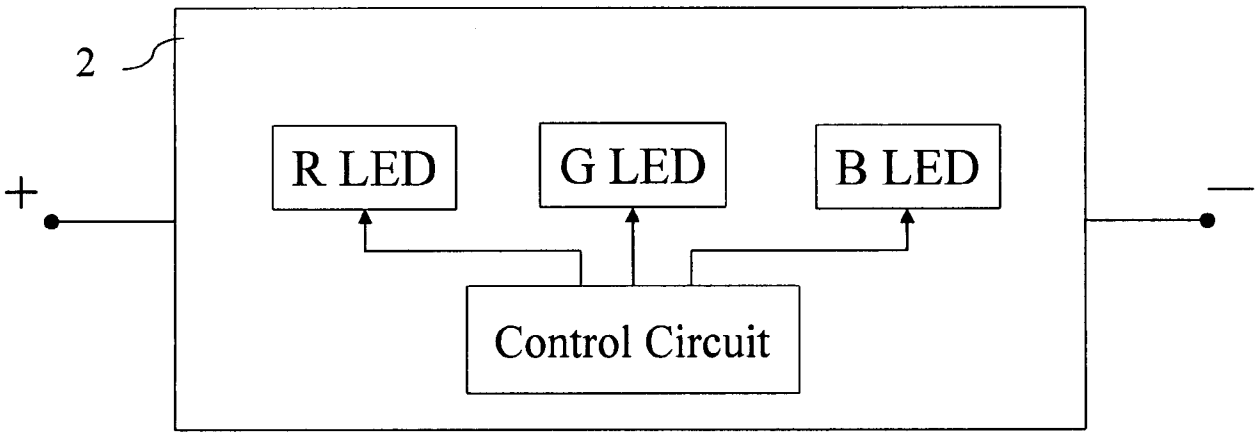
FIG. 4 is a circuit block diagram for the conventional LED lamp unit.
Figure 9A:
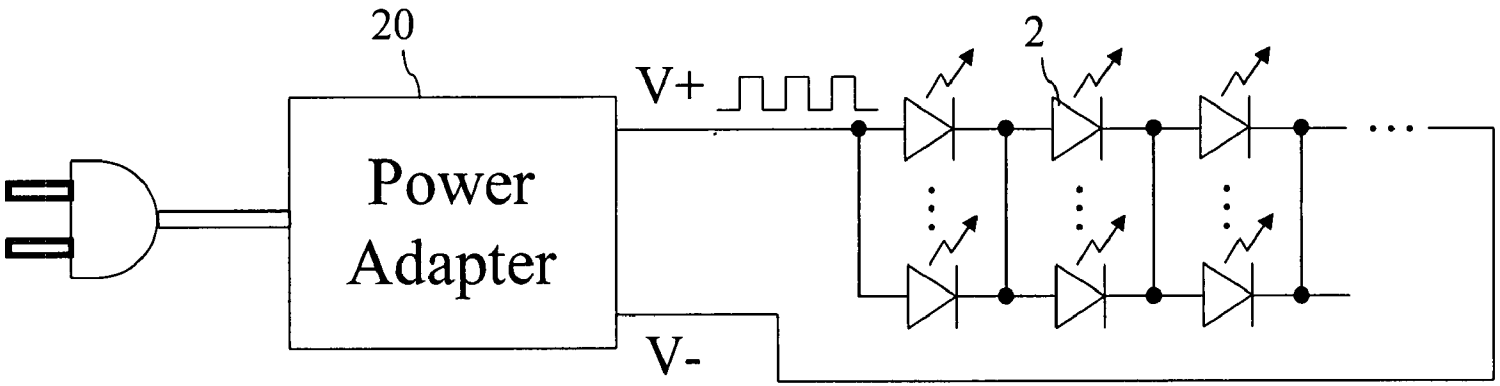
FIG. 9A and FIG. 9B is a circuit block diagram of the second embodiment for the synchronous light emitting diode lamp string according to the present invention.
Figure 9B:
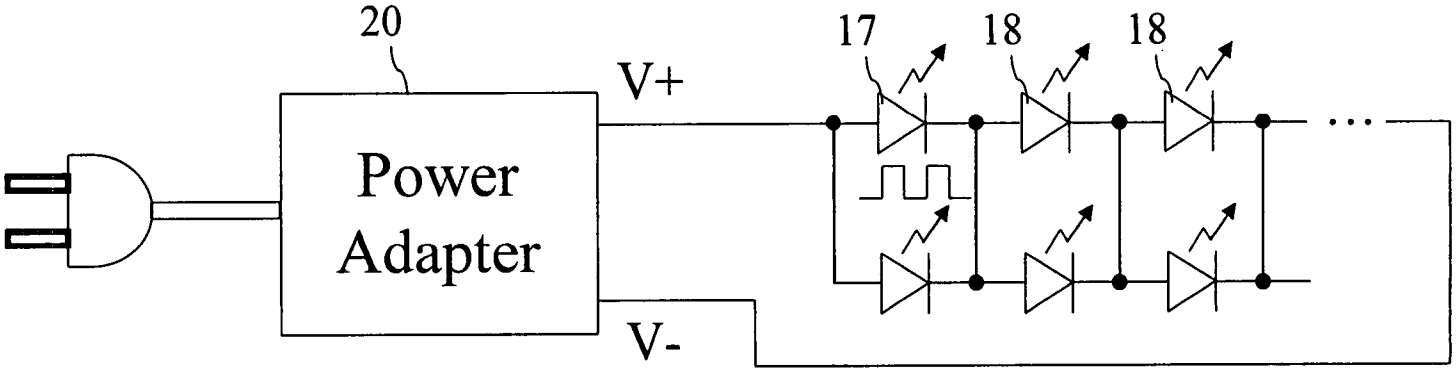

Referring to FIGS. 9A and 9B, which show the circuit block diagrams of the second embodiment for the synchronous light emitting diode lamp string according to the present invention. The second embodiment according to the present invention employs the DC voltage to provide a carrier signal, and each light emitting diode lamp can demodulate the carrier signal from the DC voltage to achieve the purpose of synchronous control. In the second embodiment according to the present invention, a synchronous light emitting diode lamp string includes a power adapter 20 and a plurality of light emitting diode lamps 2. The power adapter 20 rectifies an AC power to provide a DC voltage to drive the lamp string composed of a plurality of light emitting diode lamps. The light emitting diode lamp may be the conventional RGB light emitting diode lamp unit shown in FIG. 4, or the RGB light emitting diode lamp unit according to the present invention; wherein the light emitting diode lamps in parallel are connected serially to form the lamp string.

In the embodiment shown in FIG. 9A, the reference signal outputted from the power adapter 20 is a carrier signal on the DC voltage. The carrier signal has a constant frequency, and the carrier signal can be inputted into the light emitting diode lamp 2 through the serial connection structure of the lamp string. The control circuit 14 for each light emitting diode lamp 2 can demodulate the carrier signal from the inputted DC voltage, so that the control circuit 14 can achieve the purpose of synchronous control based on the constant frequency of the carrier signal. Moreover, the control circuit 14 for each light emitting diode lamp 2 not only has the function of demodulating the carrier signal, the control circuit 14 can also carry the carrier signal on the DC voltage to output to the next level of light emitting diode lamps 2, so that the control circuit 14 of the next level of light emitting diode lamps 2 can obtain the same carrier signal for synchronous control.

In the embodiment shown in FIG. 9B, the lamp string includes a main light emitting diode lamp 17 and a plurality of sub light emitting diode lamps 18. The control circuit of the main light emitting diode lamp 17 can provide a carrier signal carried on the DC voltage to output to the next level of sub light emitting diode lamps 18. And, the main light emitting diode lamp 17 can be controlled with color changing or flashing according to the carrier signal, and the control circuits of other sub light emitting diode lamps 18 can demodulate the carrier signal from the DC voltage provided by the main light emitting diode lamp 17 or the previous level of sub light emitting diode lamps 18 to control the color changing or flashing by the same signal. Moreover, the control circuit for each sub light emitting diode lamp 18 can also carry the carrier signal on the DC voltage to output to the next level of sub light emitting diode lamps 18, so that the control circuit of the next level of sub light emitting diode lamps 18 can obtain the same carrier signal for synchronous control.

Figure 10:
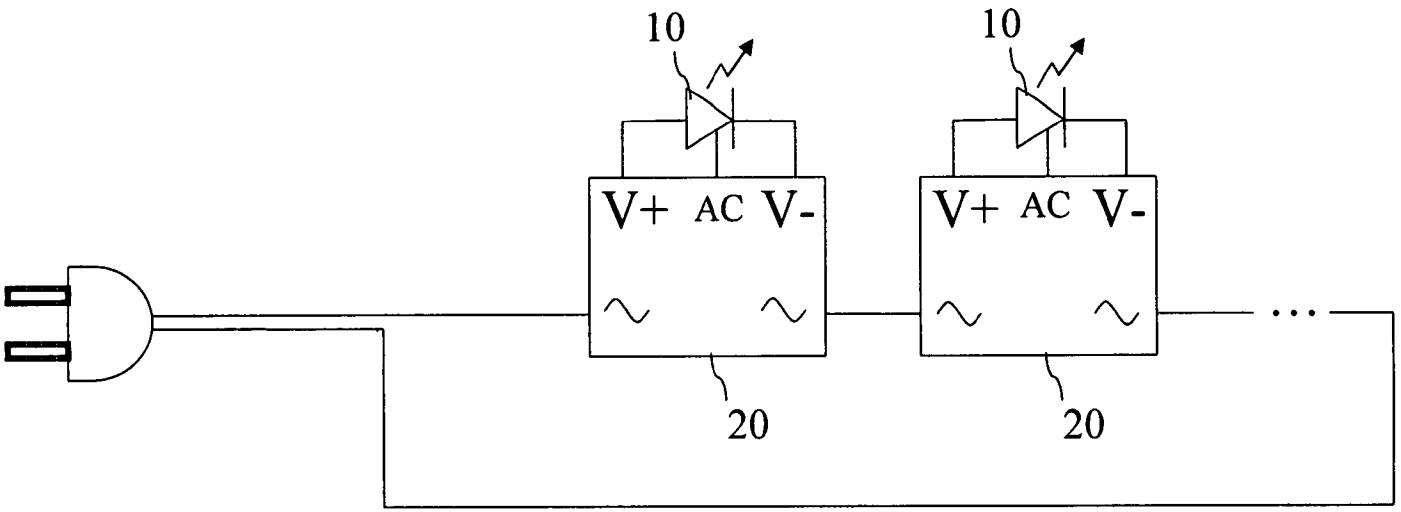
FIG. 10 is a circuit block diagram of the third embodiment for the synchronous light emitting diode lamp string according to the present invention, which includes a plurality of power adapters.

Referring to FIG. 10, it shows a circuit block diagram of the third embodiment for the synchronous light emitting diode lamp string according to the present invention. In the third embodiment according to the present invention, a synchronous light emitting diode lamp string includes a plurality of power adapters 20 and a plurality of light emitting diode lamps 10. Each power adapter 20 can individually rectify the AC power to provide a DC voltage to drive a light emitting diode lamp 10, and the light emitting diode lamp 10 is a RGB light emitting diode lamp shown in FIG. 5 or the single-color light emitting diode lamp. The plurality of power adapters 20 is connected serially with each other to accept an AC power. The synchronous pins of the light emitting diode lamp 10 receive the reference signal outputted from the individual power adapter 20, and the frequency of the reference signal is generated from the frequency of the AC power inputted from the power adapter 20.

Figure 11:
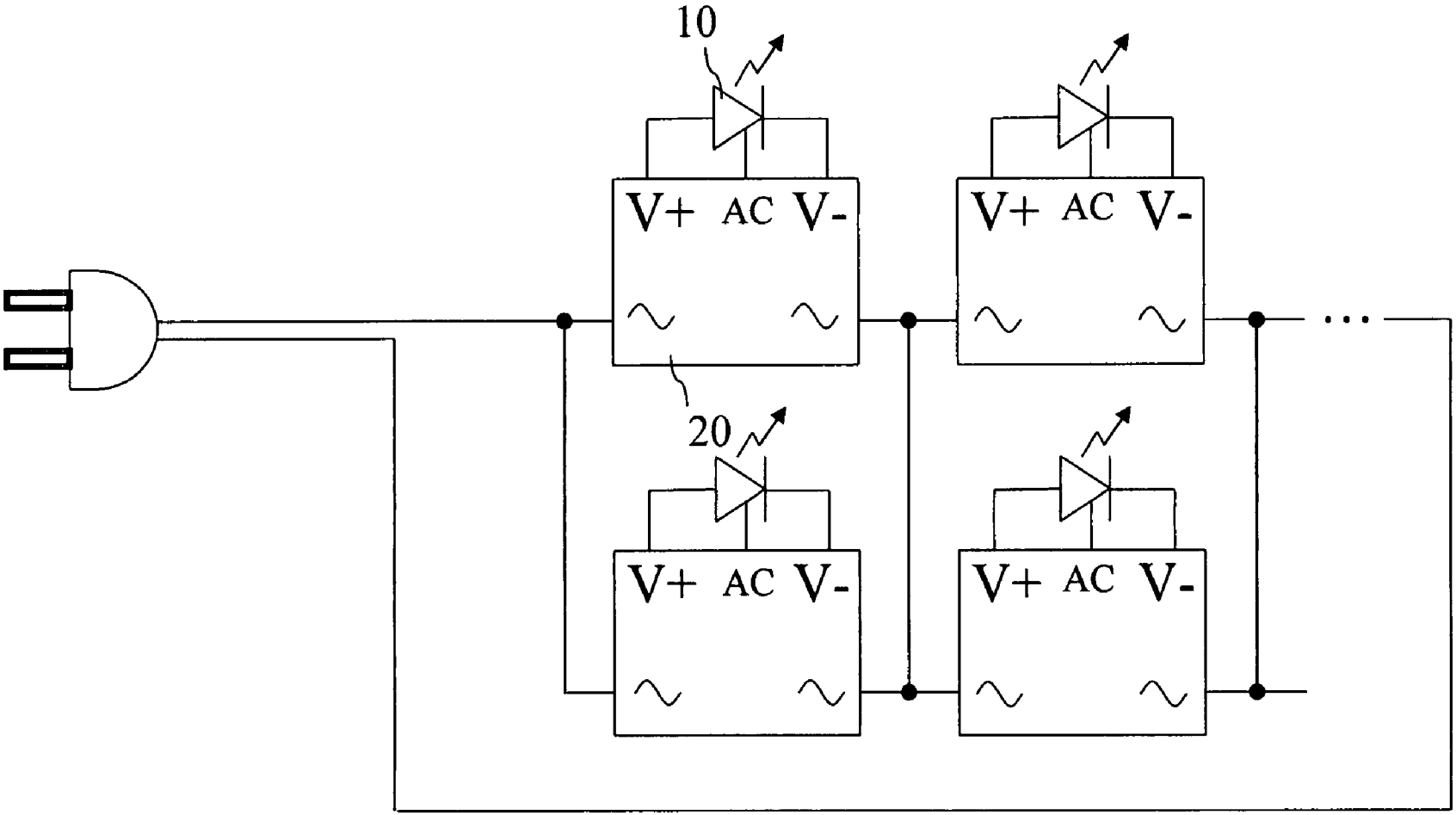
FIG. 11 is another circuit block diagram of the third embodiment for the synchronous light emitting diode lamp string according to the present invention, which includes a plurality of power adapters.

Referring to FIG. 11, it shows another circuit block diagram of the third embodiment for the synchronous light emitting diode lamp string according to the present invention. The embodiment shown in FIG. 11 is a modification to the embodiment shown in FIG. 10. The difference is that the power adapters 20 in parallel are serially connected with each other to accept an AC power.

Figure 12:
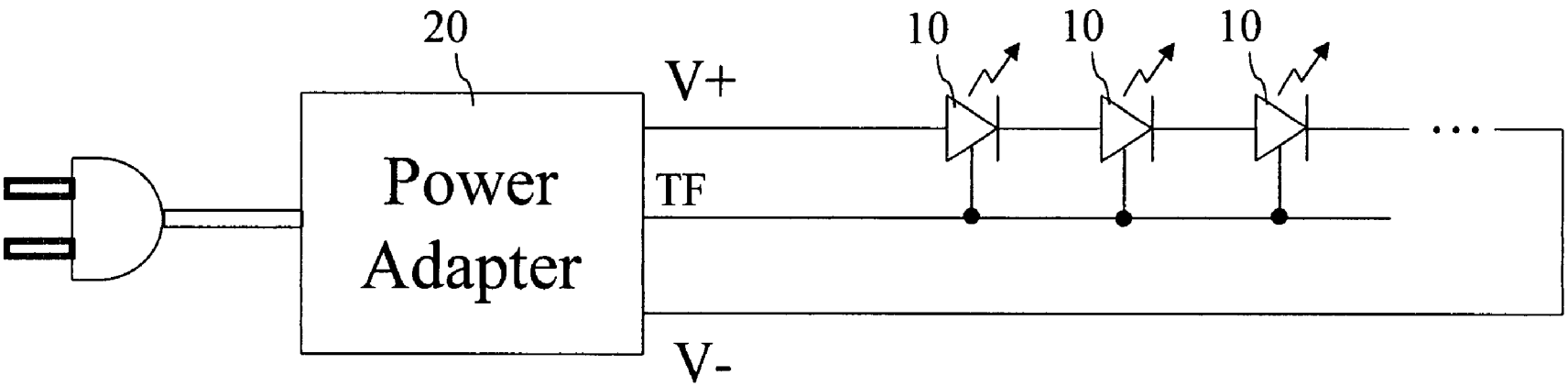
FIG. 12 is another circuit block diagram for the synchronous light emitting diode lamp string according to the present invention.

Referring to FIG. 12, it shows another circuit block diagram for the synchronous light emitting diode lamp string according to the present invention. In this embodiment according to the present invention, a synchronous light emitting diode lamp string includes a power adapter 20 and a plurality of light emitting diode lamps 10. The power adapter 20 rectifies an AC power to provide a DC voltage to drive the lamp string composed of a plurality of light emitting diode lamps 10 in serial connection. And, the light emitting diode lamp is a RGB light emitting diode lamp shown in FIG. 5, or the single-color light emitting diode lamp.

In this embodiment according to the present invention, the light emitting diode lamps 10 composing the lamp string are all the sub light emitting diode lamps 18 in the embodiment shown in FIG. 6, and the synchronous pins of all sub light emitting diode lamps 18 receive the reference signal outputted from the power adapter 20; wherein, the reference signal is a rhythm signal representing music, so that the lamp color of the lamp string can be changed to different colors following the music rhythm.

Figure 13A:
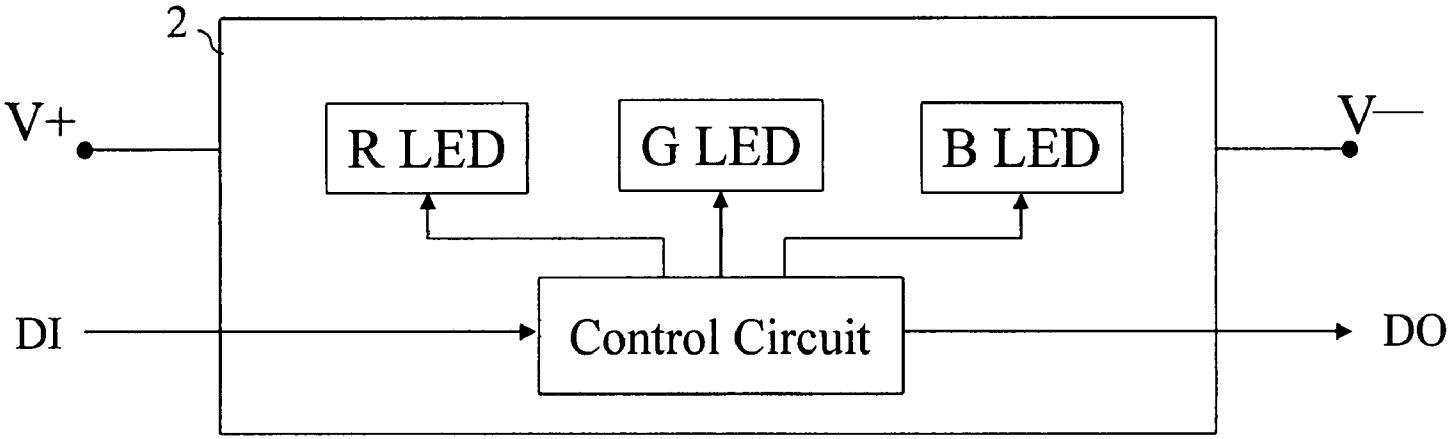
FIG. 13A is another circuit block diagram of the light emitting diode lamp of the present invention.

Referring to FIG. 13A, it shows another circuit block diagram of the light emitting diode lamp of the present invention. In this embodiment, the present invention provides a RGB light emitting diode lamp 10, which includes a red light emitting diode (R LED) 11, a green light emitting diode (G LED) 12, a blue light emitting diode (B LED) 13 and a control circuit 14. The control circuit 14 can be realized by an integrated circuit, and the control circuit 14 drives the color changing sequence or flashing type or of R LED 11, G LED 12 and B LED 13 based on a signal input from the pin DI.

In this embodiment, the RGB light emitting diode lamp has four pins, which are an anode pin V+, a cathode pin V−, an input pin DI and an output pin DO as shown in FIG. 12B. The anode pin and cathode pin receive a DC voltage. The DC voltage is a working voltage of the light emitting diode lamp 10. The signal received by the input pin DI is input to the control circuit 14, and the output pin DO outputs a command or data of the control circuit 14. The signals transmitted by the input pin DI and output pin DO not only can be formed of a clock signal as a synchronous signal but also served for transmission of data. Hence, for a lamp string composed of the light emitting diode lamps 10 shown in FIG. 13A, the input pin DI of one of the light emitting diode lamps 10 is connected to the output pin DO of the previous-level light emitting diode lamp 10, and the output pin DO of the light emitting diode lamp 10 is connected to the input pin DI of the next-level light emitting diode lamp 10. 10

Figure 14:
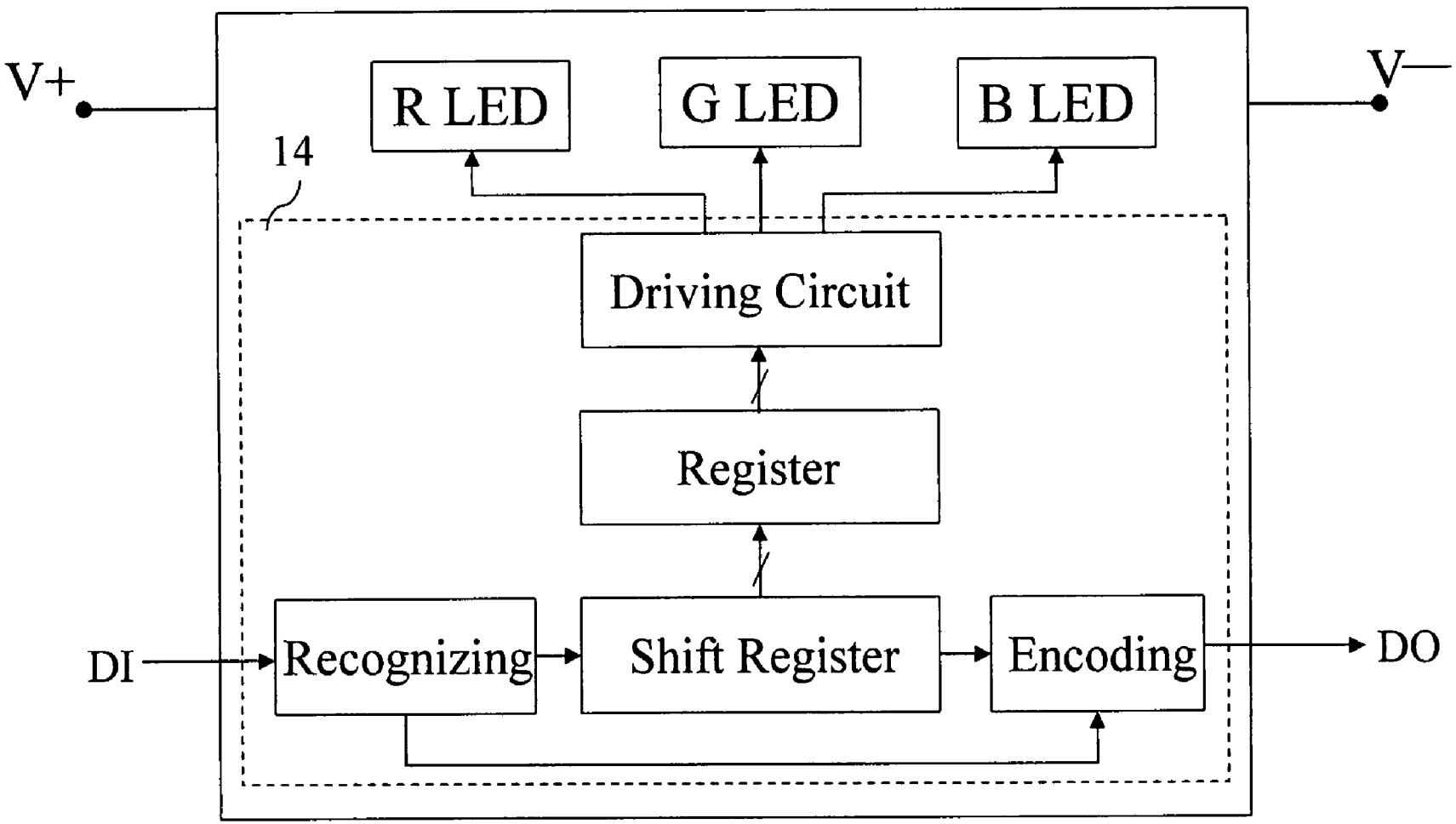
FIG. 14 is a circuit block diagram of the control circuit of FIG. 13A.

Referring to FIG. 14, which shows a circuit block diagram of the control circuit of FIG. 13A. The control circuit of the RGB light emitting diode lamp 10 includes a recognition block for receiving the signal of the input pin to recognize, a shift register for receiving data transmitted from the recognition block, a register for receiving the complete data stored in the shift register, a driving circuit for driving the color changing sequence or flashing type of the R LED 11, G LED 12 and the B LED 13 based on the complete data of the register, and an encoding block receiving an instruction of the recognition block to encode the complete data of the shift register and output to the output pin DO, wherein the recognition block determines whether the data transmitted by the input pin DI is an command of the light emitting diode lamp itself 10 or to re-encode the data and transmitting to the next-level light emitting diode lamp 10 via the output pin DO.

Figure 13B:
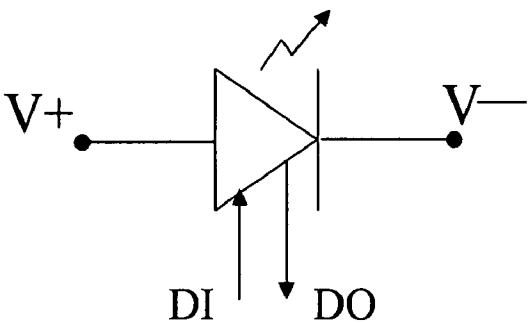
FIG. 13B is a representation of the circuit block diagram of FIG. 13A.
Figure 15:
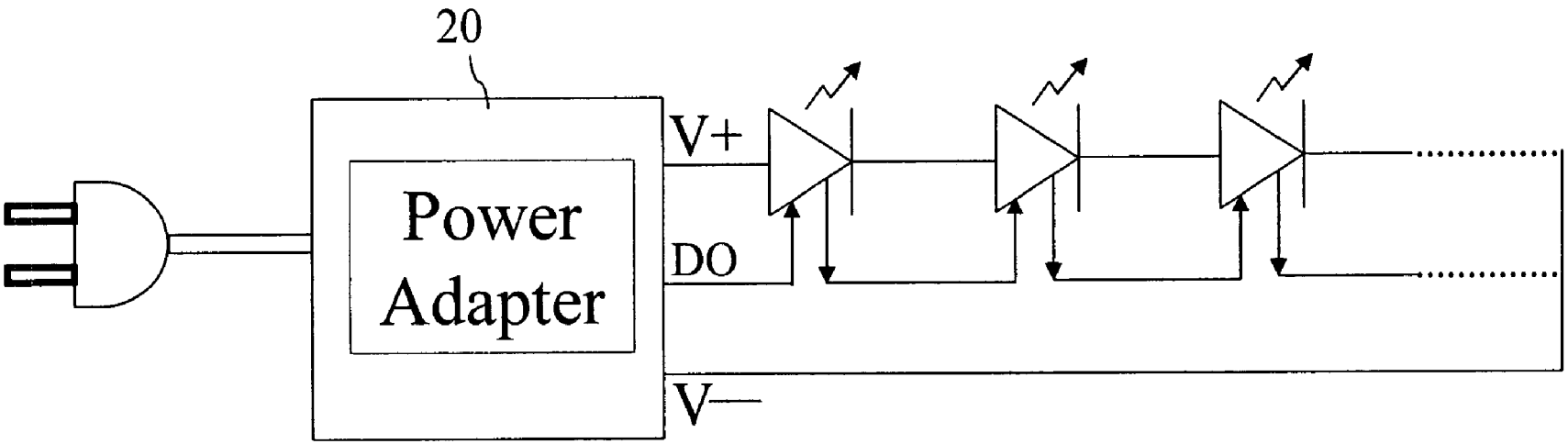
FIG. 15 is a circuit block diagram of a synchronous light emitting diode lamp string of the present invention, which includes the light emitting diode lamp of FIG. 13A.

FIG. 15 shows a synchronous light emitting diode lamp string including a plurality of the light emitting diode lamps 10 each of which is as shown in FIG. 13 or FIG. 14. The light emitting diode lamps 10 are serially connected together, and the output pin DO of the previous-level light emitting diode lamp 10 is connected to the input pin DI of the next-level light emitting diode lamp 10. In this embodiment, the power adapter 20 for providing a DC voltage to the synchronous light emitting diode lamp string has a capability of data processing. The power adapter 20 can output a command to the input pin DI of the first light emitting diode lamp 10 via a signal line DO to control the color changing sequence or flashing type of the synchronous light emitting diode lamp string.

The power adapter 20 can install a microprocessor or data processor and a memory for storing data of showing the design effects of the lamp string, for example a running-lamp effect or a pursuing-lamp effect. The lamp string even can show a particular pattern. Once the power is provided, the microprocessor or data processor captures the data stored in the memory, and the different signals including data and clock signals as well as the data of showing the design effects are transmitted in a specific data format via a signal line DO.

Figure 16A:
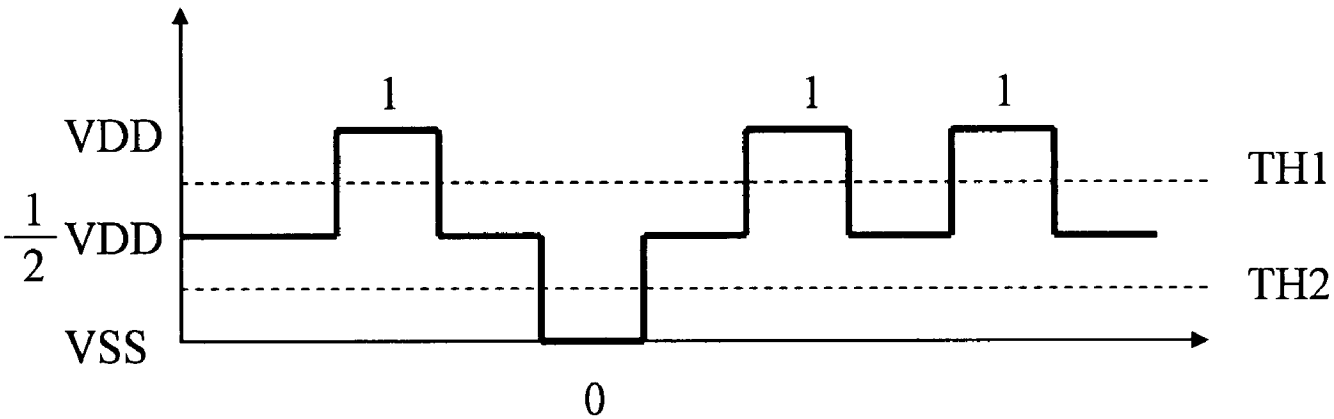
FIGS. 16A and 16B respectively show an illustration of data transmission of the present invention.

There are two methods for transmitting data in the embodiment of FIG. 15. One is a method employing voltage potential and clock as shown in FIG. 16A. Before the power adapter 20 begins to transmit data, the signal line DO is in a state without data, which is represented by a voltage potential of ½ VDD. When the power adapter 20 begins to transmit the data, digital signal "1" or "0" represents a command executed by each of the RGB light emitting diode lamp 10. The action to be executed is pre-defined.

During the process for transmitting data, when the transmission of each bit "1" or "0" is over, the signal line returns to the voltage potential of ½ VDD, and then transmitting the next bit. The data and clock can be simultaneously transmitted. The control circuit 14 of each of the RGB light emitting diode lamps 10 receives the data, decodes and recognizes the data, and encoding the data to a similar signal format, and then transmitting to the next-level light emitting diode lamp 10. The total number of the light emitting diode lamps 10 is determined at the initial to organize each of the synchronous light emitting diode lamp string. When it is required to change brightness, the microprocessor or data processor transmits bit number equal to the total number of the light emitting diode lamps. The data is input to each of the RGB LED and output from it. Therefore, each bit can be properly transmitted to each of the light emitting diode lamp 10.

After the data transmission is over, the signal line DO and the output pin DO of the light emitting diode lamp 10 stay in the voltage potential of ½VDD. The present invention can define each DO staying in the voltage potential of ½VDD exceeds a period of time, the data is locked and shown out. Hence, only changing different contents of memory, this embodiment can obtain the lamp strings with different flashing types or various showing. The embodiment provides a more flexible design.

Figure 16B:
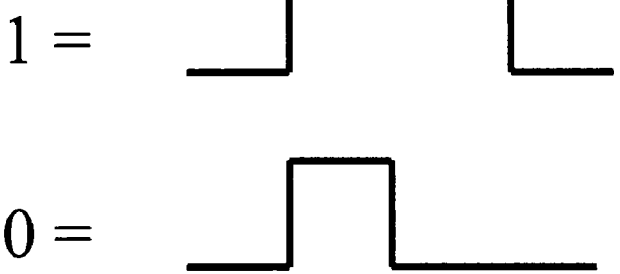

Another data transmission is as shown in FIG. 16B, which encodes the data. The data and clock are transmitted in forms of digital signals "1" and "0" which have predefined time intervals. Similarly, it can be defined that the signal line stays in a voltage potential of VDD or VSS, when there is no signal transmitted through the signal line. When the signal line staying in the voltage potential exceeds a period of time, it represents locking commands and showing the change. As such, it also successfully attain to the purpose of using one signal line to transmit data, clocks and show signals. The difference between the two methods is the former recognizes data in a static way and the latter requires each RGB light emitting diode lamp 10 generates clocks to recognize data.

The design of the lamp string has not only the synchronous concept in the present invention, but also if the lamp string only has the synchronous color changing that would be too tedious. Thus, it would be preferably to achieve both synchronous changing and asynchronous flashing during a certain period of time, and the design of lamp string can have fruitful change. The current conventional lamp string has multiple patterns, such as running lamp, pursuing lamp, etc. The LED lamp string according to the present invention can also provide these functions. In the embodiment according to the present invention, it first classifies LED lamps into several types, such as No. 1, No. 2, No. 3, etc. When entering running lamp or pursuing function, the control circuit of the LED lamp can delay the synchronous frequency of the synchronous signal based on the classified type, so as to achieve the functions, like running lamp or pursuing. For example, the control circuit of LED lamp in No. 1 can delay the synchronous frequency in a constant period of time, and the LED lamp in No. 2 can delay the same frequency in twice the constant period of time, and so on to immediately appear the effect of running lamp or pursuing.

In different embodiments according to the present invention, the LED lamp in No. 1 is kept to light one color, and the LED lamp in No. 2 lights another color, and so on, and they will change different colors through a period of time to appear the effect of multi-color pursuing. The LED lamp string applied according to the present invention can be designed as more complete, and versatile lamp string products.

After detailed description of the preferred embodiments according to the present invention, those skilled in the art can clearly understand to conduct various change and modification without departing from the scope and spirit of the claims hereinafter, and the present invention is not limited to the applications of embodiments listed in the application context.

What is claimed is:

1. A light emitting diode lamp having an anode pin, a cathode pin, a data input pin and a data output pin, which is characterized in:

said light emitting diode lamp is composed of at least a light emitting diode and a control circuit without a clock source, said data input pin and data output pin electrically connect with said control circuit; wherein said control circuit obtains data and clock signals in response to the status of said data input pin and controls illumination of said light emitting diode based on the data from said data input pin;

wherein said control circuit outputs the data from said data input pin to the data output pin.

2. The light emitting diode lamp as claimed in claim 1, which includes a red light emitting diode, a green light emitting diode and a blue light emitting diode, and said control circuit controls flashing type or color change of said red light emitting diode, said green light emitting diode and said blue light emitting diode based on the data from said data input pin.

3. The light emitting diode lamp as claimed in claim 1, wherein said control circuit includes a recognition block for receiving the data from said data input pin to recognize, a shift register for receiving data transmitted from said recognition block, a register for receiving complete data stored in said shift register, a driving circuit for driving said light emitting diode to illuminate based on the complete data of said register, and an encoding block for receiving an instruction from said recognition block to determine encoding the complete data of said shift register and outputting to said data output pin.

* * * * *